US005929572A

United States Patent [19]

Whitesell

[11] Patent Number: 5,929,572

[45] Date of Patent: Jul. 27, 1999

[54] ELECTROLUMINESCENT ARRAYS LAYERED TO FORM A VOLUMETRIC DISPLAY

[75] Inventor: Eric James Whitesell, San Diego, Calif.

[73] Assignee: The United States of America as represented by the Secretary of the Navy, Washington, D.C.

[21] Appl. No.: 08/715,979

[22] Filed: Sep. 19, 1996

[51] Int. Cl.[6] ..... H05B 37/02

[52] U.S. Cl. ..... 315/169.3; 313/500; 313/501; 313/505; 313/506; 313/509; 128/653.1; 345/76; 345/82; 345/83

[58] Field of Search ..... 313/500, 501, 313/505, 506, 509; 128/653.1; 315/169.3, 169.1; 345/76, 82, 83

[56] References Cited

U.S. PATENT DOCUMENTS

| | | | |
|---|---|---|---|
| 4,754,202 | 6/1988 | Havel | 315/169.1 |
| 4,924,144 | 5/1990 | Menn et al. | 313/506 |
| 5,359,341 | 10/1994 | Hutchings | 315/169.3 |
| 5,803,082 | 9/1998 | Stapleton et al. | 128/653.1 |

*Primary Examiner*—Michael B Shingleton

*Attorney, Agent, or Firm*—Harvey FEndelman; Michael A. Kagan; Eric James Whitesell

[57] ABSTRACT

A solid state 3-D display comprises an array of voxels made of an electroluminescent material arranged in a matrix of a transparent material. Transparent electrodes are formed in the matrix to form electrical connections to each voxel. The transparent electrodes are connected to voltage sources outside the display volume for controlling the optical output of each voxel to produce a three-dimensional image inside the display volume.

13 Claims, 5 Drawing Sheets

ELECTROLUMINESCENT ARRAYS LAYERED TO FORM A VOLUMETRIC DISPLAY

LICENSING INFORMATION

The invention described below is assigned to the United States Government and is available for licensing commercially. Technical and licensing inquiries may be directed to Harvey Fendelman, Legal Counsel For Patents, NCCOSC RDTE DIV CODE 0012, 53510 Silvergate Avenue Room 103, San Diego, Calif. 92152-5765; telephone no. (619)553-3818; fax no. (619)553-3821.

BACKGROUND OF THE INVENTION

The present invention relates to solid state displays. More specifically, but without limitation thereto, the present invention relates to a solid state three-dimensional display.

3-D display technologies such as holography, stereoscopic displays, and advanced 3-D graphics engines generally render 3-D images as a two-dimensional display by mapping the coordinates of the 3-D images into 2-D perspective. However, these technologies lack the physiological depth cues needed for true 3-D display imaging, such as motion parallax, accommodation, convergence, and binocular disparity. A 3-D volumetric display provides the physiological depth cues needed for such applications as air traffic control, submarine undersea navigation, and medical imaging.

A need therefore exists for a 3-D display that has the advantages of providing true physiological depth cues that can operate in a wide variety of environments, including aircraft and marine vessels.

SUMMARY OF THE INVENTION

The solid state 3-D display of the present invention is directed to overcoming the problems described above, and may provide further related advantages. No embodiment of the present invention described herein should be construed to preclude other embodiments or advantages that may exist or become obvious to those skilled in the art.

The solid state 3-D display of the present invention comprises an array of voxels made of an electroluminescent material arranged in a matrix of a transparent material. Transparent electrodes are formed in the matrix to form electrical connections to each voxel. The transparent electrodes are connected to voltage sources outside the display volume for controlling the optical output of each voxel to produce a three-dimensional image inside the display volume.

An advantage of the solid state 3-D display of the present invention is that images may be displayed with physiological depth cues, including motion parallax, accommodation, convergence, and binocular disparity.

Another advantage is that inexpensive, well developed technology developed for 2-D liquid crystal displays may be used to manufacture the solid state 3-D display.

Yet another advantage is that the solid state 3-D display may readily be controlled by sequential and parallel driving methods.

The features and advantages summarized above in addition to other aspects of the present invention will become more apparent from the description, presented in conjunction with the following drawings.

DESCRIPTION OF THE INVENTION

The following description is presented solely for the purpose of disclosing how the present invention may be made and used. The scope of the invention is defined by the claims.

Figure 1:
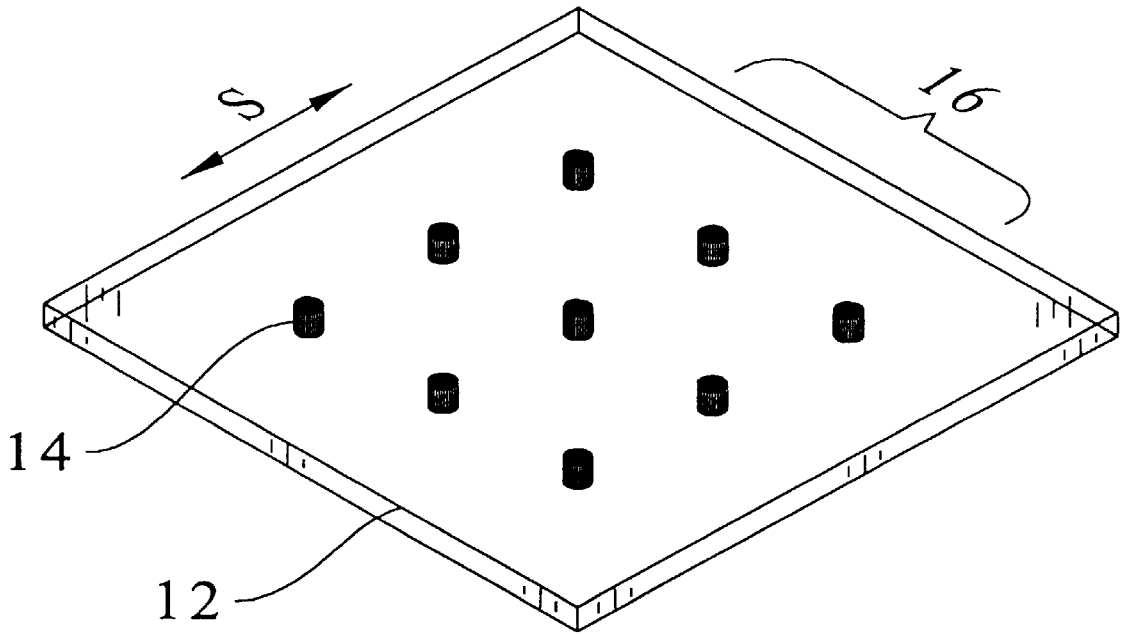
FIG. 1 is perspective view of a transparent matrix containing an array of electroluminescent voxels.

In FIG. 1, a matrix 12 made of a transparent material such as optical glass or sapphire has holes 14 enclosing an elctroluminescent material to form an array of voxels 16. The electroluminescent material may be, for example, a light-emitting diode or a pair of LED's conducting in opposite directions. The ratio of the size of voxels 16 to the spacing S between each voxel is selected to provide the desired resolution and overall translucence.

Figure 2:
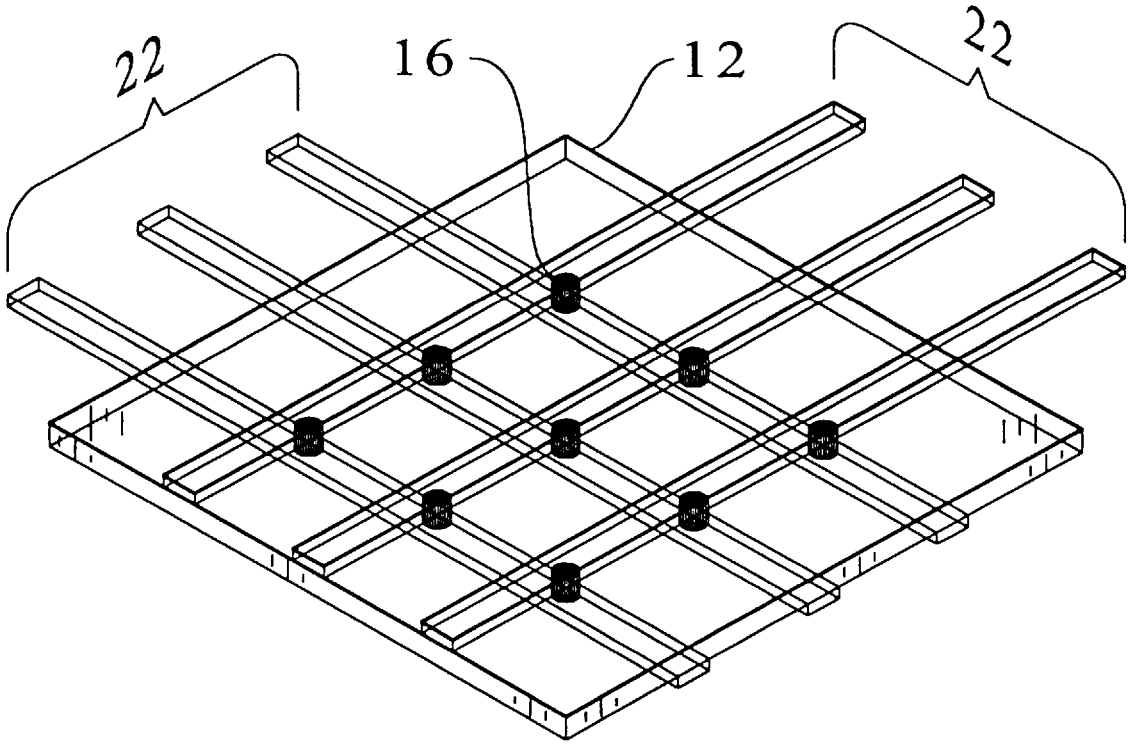
FIG. 2 illustrates the addition of transparent row and column electrodes forming electrical connections to the voxels in the matrix of FIG. 1.

In FIG. 2, transparent electrodes 22 are deposited on matrix 12 to make electrical connections to voxels 16 by rows and columns respectively according to well known techniques such as those used in liquid crystal display technology. Transparent electrodes 22 may be made of a transparent, electrically conductive material such as indium tin oxide.

Figure 3:
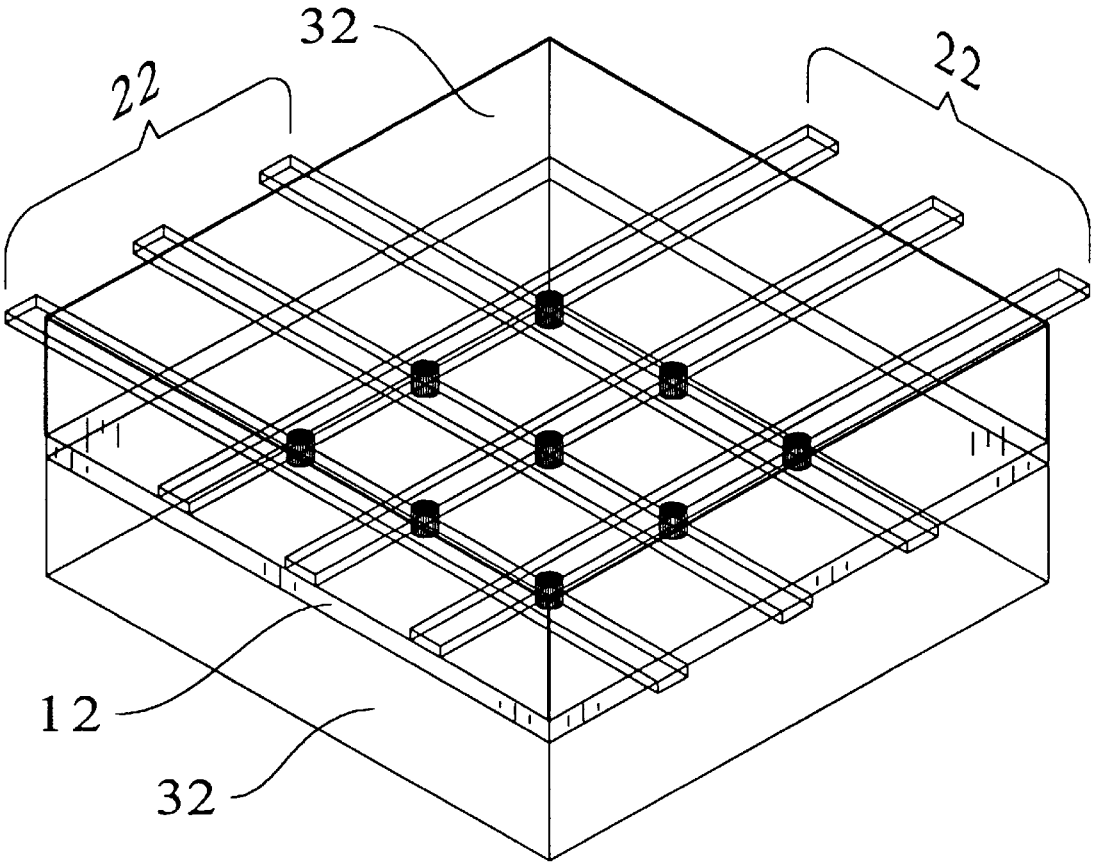
FIG. 3 illustrates the addition of a transparent spacing layer to upper and lower surfaces of FIG. 2 to form a 2-D display.
Figure 4:
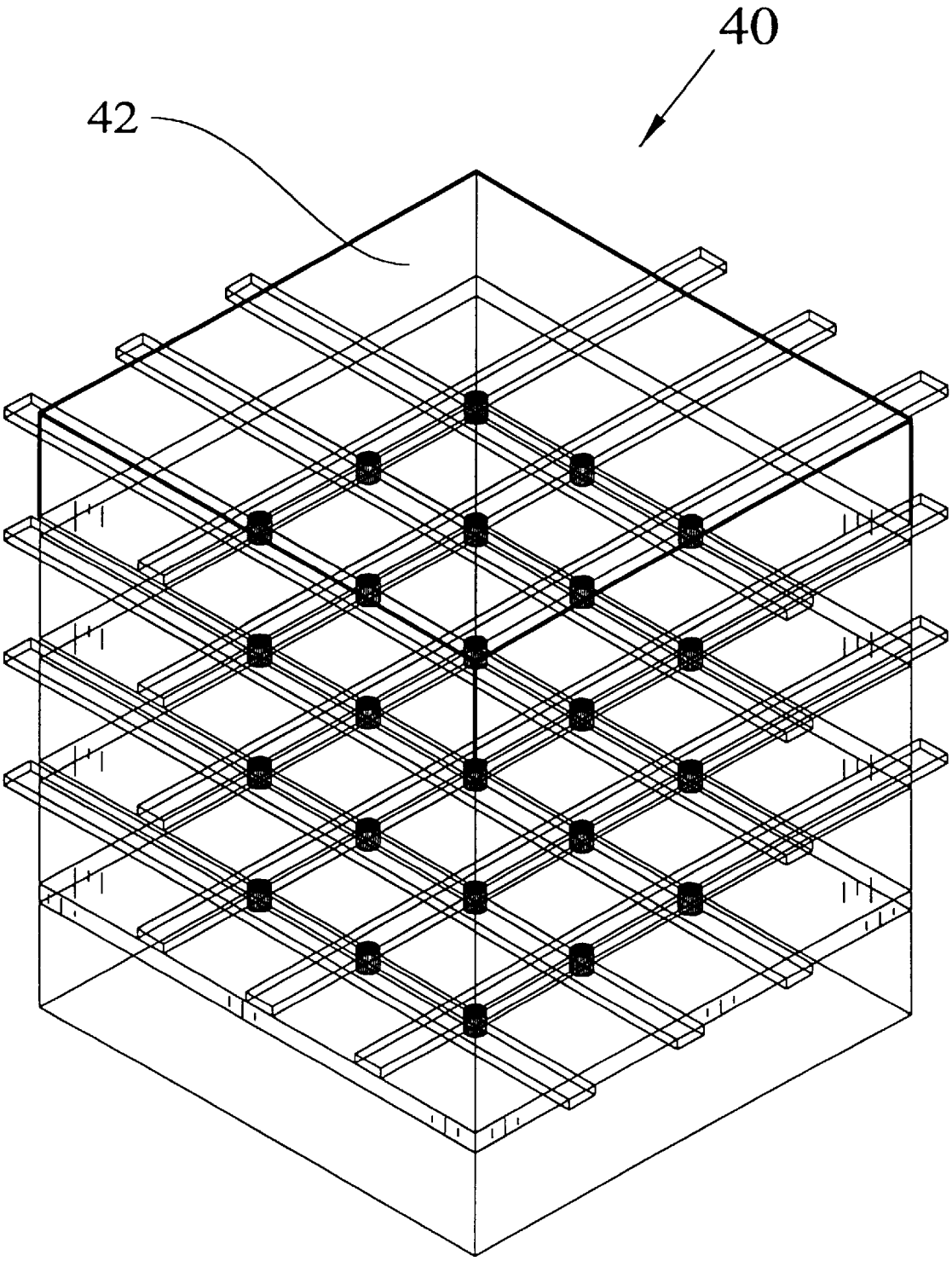
FIG. 4 is a perspective view of a display volume formed by a stack of the 2-Displays in FIG. 3.

In FIG. 3, a transparent spacer layer 32 may be combined with transparent electrodes 22 to maintain a selected spacing in the vertical direction for stacking multiple arrays of voxels 16 as shown in FIG. 4 to form a display volume 40. Transparent spacer layer 32 may be made of a transparent, electrically insulating material such as optical glass or sapphire. Antireflective coatings 42 made of materials well known in optics may be added to reduce reflections inside display volume 40.

Figure 5:
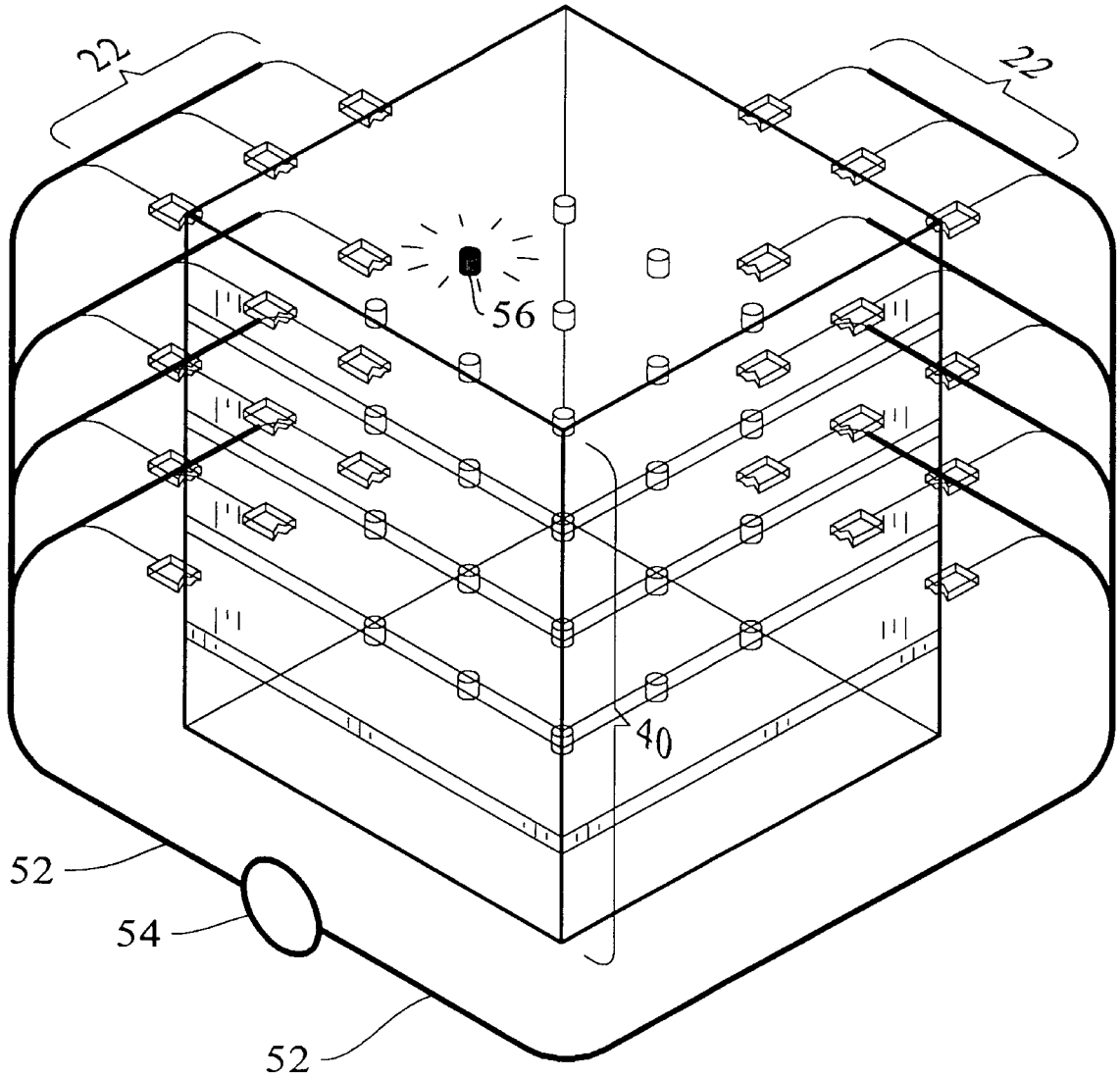
FIG. 5 illustrates a voltage source connected by row and a column electrode to cause an individual voxel to emit light.

In FIG. 5, electrical connections 52 connect an isolated voltage source 54 outside display volume 40 to a voxel 56 inside display volume 40 via the corresponding row and column electrodes 22. Connections 52 may be made to electrodes 22 by rows and columns from the back and bottom of display volume 40, respectively. Display volume 40 may be shaped as a cube, cylinder, or other desired geometry. Voltage source 54 may be, for example, a photovoltaic cell, a pair of photovoltaic cells connected in parallel to provide a bipolar voltage, or an isolation transformer. Photovoltaic cells may be scanned sequentially by a laser scanner or in parallel by, for example, a laser diode array to control the illumination of each of voxels 16.

Alternatively, voltage source 54 may be a photovoltaic cell pair or an isolation transformer for coupling an alternating voltage signal to control the color of a pair of LED's connected in parallel with their polarities opposed.

Other modifications, variations, and applications of the present invention may be made in accordance with the above teachings other than as specifically described to practice the invention within the scope of the following claims.

I claim:

1. A solid state display comprising:

a matrix made of a substantially transparent material defining a display volume;

an array of voxels made of an electroluminescent material arranged in said matrix;

a plurality of substantially transparent electrodes operably coupled to said array of voxels for connecting said array of voxels to at least one voltage source outside said display volume;

and a spacer layer comprising a substantially transparent material overlaying said electrodes;

wherein said matrix, said array of voxels, said electrodes, and said spacer layer are multiplied and coupled to form a three-dimensional display.

2. The solid state display of claim 1 wherein said matrix comprises at least one of optical glass and sapphire.

3. The solid state display of claim 1 wherein said transparent electrodes comprise indium tin oxide.

4. The solid state display of claim 1 wherein said electroluminescent material comprises at least one of a light emitting diode for single color luminescence and a pair of light emitting diodes connected in parallel with opposing polarities for multi-color luminescence.

5. The solid state display of claim 1 further comprising said voltage source for causing at least one of said voxels to emit light.

6. The solid state display of claim 5 wherein said voltage source comprises at least one of a photovoltaic cell, a pair of oppositely connected photovoltaic cells, and an isolation transformer operably coupled to at least one of said voxels.

7. A solid state display comprising:

a matrix comprising a substantially transparent material;

an array of voxels comprising an electroluminescent material arranged in said matrix;

a plurality of substantially transparent electrodes operably coupled by row and column to said array of voxels for connecting said array of voxels to at least one voltage source outside said matrix;

and a spacer layer comprising a substantially transparent material overlaying said electrodes;

wherein said matrix, said array of voxels, said electrodes, and said spacer layer are multiplied and coupled to form a three-dimensional display.

8. The solid state display of claim 7 wherein said matrix comprises at least one of optical glass and sapphire.

9. The solid state display of claim 7 wherein said transparent electrodes comprise indium tin oxide.

10. The solid state display of claim 7 wherein said electroluminescent material comprises at least one of a light emitting diode and a pair of light emitting diodes connected in parallel with opposing polarities.

11. The solid state display of claim 7 further comprising said voltage source for causing at least one of said voxels to emit light.

12. The solid state display of claim 11 wherein said voltage source comprises at least one of a photovoltaic cell, a pair of oppositely connected photovoltaic cells, and an isolation transformer operably coupled to at least one of said voxels.

13. The solid state display of claim 12 wherein said spacer layer comprises at least one of optical glass and sapphire.

* * * * *